United States Patent [19]

Kubotera et al.

[11] 4,298,673

[45] Nov. 3, 1981

[54] LITHOGRAPHIC TYPE DIFFUSION TRANSFER DEVELOPING COMPOSITION

[75] Inventors: Kikuo Kubotera; Eiichi Mizuki; Masato Satomura, all of Asaka; Haruhiko Iwano; Tadahiro Fujiwara, both of Minami-ashigara, all of Japan

[73] Assignee: Fuji Photo Film Co., Ltd., Minami-ashigara, Japan

[21] Appl. No.: 884,672

[22] Filed: Mar. 6, 1978

Related U.S. Application Data

[63] Continuation of Ser. No. 339,455, Mar. 8, 1973, abandoned.

[30] Foreign Application Priority Data

Mar. 10, 1972 [JP] Japan ..... 47/24533

[51] Int. Cl.[3] ..... G03C 5/54

[52] U.S. Cl. ..... 430/204; 430/248; 430/249; 430/456; 430/478; 430/480; 430/485; 430/487; 430/490

[58] Field of Search ..... 96/29 L, 29 R, 66 HD, 96/66.3; 430/249, 250, 486, 204, 456, 478, 480, 485, 487, 248, 481, 482

[56] References Cited

U.S. PATENT DOCUMENTS

| | | | |
|---|---|---|---|
| 2,289,367 | 7/1942 | Kendall | 96/66 HD |
| 3,000,736 | 9/1961 | Karlson | 96/66 HD |
| 3,255,008 | 6/1966 | Tefft | 96/66 HD |
| 3,723,118 | 3/1973 | Iwano et al. | 96/29 R |
| 3,740,221 | 6/1973 | Willems et al. | 96/29 R |
| 3,806,345 | 4/1974 | Willems et al. | 96/29 R |
| 3,853,557 | 12/1974 | Fassbender | 96/2 RR |
| 3,870,479 | 3/1975 | Kubotera | 96/29 L |

OTHER PUBLICATIONS

Mees & James "The Theory of the Photographic Process" 3rd ed. p. 370.

*Primary Examiner*—Richard L. Schilling
*Assistant Examiner*—John L. Goodrow
*Attorney, Agent, or Firm*—Sughrue, Mion, Zinn, Macpeak and Seas

[57] ABSTRACT

A lithographic type diffusion transfer developing composition which provides high contrast images having sharp toe-gradation for developing silver halide light-sensitive materials contains at least one amine represented by one of the following general formulae (I), (II) or (III):

$$H_2N\text{-}C_nH_{2n}\text{-}X \quad \text{(I)}$$

(II)

(III)

X, X', $R_1$, n and m are defined in the specification. The process of developing using such a composition is also disclosed.

13 Claims, 6 Drawing Figures

D
RELATIVE LOG E
4.0
3.0
2.0
1.0
0.0
1
2
3
4
5
6
7
8
9
10
A
B
C
D
E
F
G
H
I
J
K
L
M
N
O

LITHOGRAPHIC TYPE DIFFUSION TRANSFER DEVELOPING COMPOSITION

CROSS REFERENCE TO RELATED APPLICATIONS

This is a continuation of copending application Ser. No. 339,455, filed Mar. 8, 1973, now abandoned.

BACKGROUND OF THE INVENTION

1. Field of the Invention

The present invention relates to a lithographic type diffusion transfer developing composition which is prepared by incorporating an amine compound or the derivative thereof in a diffusion transfer developing composition. The object of the invention is to directly prepare a half-tone photographic original plate having excellent half-tone dot quality with low fringe, by a positive-positive diffusion transfer development.

2. Description of the Prior Art

In the art of photographic plate-making the continuous gradation of an original must be converted to a half-tone dot gradation. According to standard processes commonly practiced at present a half-tone negative or half-tone positive photographic original plate comprising hard dots is prepared by covering an original having a continuous gradation with a screen, printing it on a high contrast lithographic type light-sensitive material and then subjecting it to a lithographic type development (this process is described in "Photographic Processing Chemistry", pp. 163–165, written by Mason and issued by Focal Press Limited in 1966).

However, in a process of conducting lithographic development using a lithographic light-sensitive material a positive original is converted to a half-tone negative while a negative original is converted to a half-tone positive. Such a process is a so-called negative-positive process, and hence a positive half-tone dot original plate cannot directly be prepared from a positive original or a negative half-tone dot original plate from a negative original. Accordingly, in the case of a positive-positive process an original must first be converted to an intermediate half-tone negative, which is then subjected to reversal.

It will be clear from the above discussion that the direct preparation of a half-tone dot photographic original plate from an original without preparing an intermediate negative would be advantageous from an economical viewpoint and serve to simplify such processing.

SUMMARY OF THE INVENTION

It is, therefore, one object of the present invention to prepare a half-tone dot photographic original plate by the process of diffusion transfer development.

Another object of the invention is to provide a process for improving the half-tone dot photographic properties, particularly to markedly reducing the formation of fringe in a diffusion transfer development.

A further object of the invention is to provide a diffusion transfer developer having good preservability, since a diffusion transfer developer, particularly a sulfite ion-free diffusion transfer development, shows weak resistance against air oxidation.

Still a further object of the invention is to provide a process for optionally changing the maximum density without a reduction in the contrast of a transferred positive silver image by varying the amount of the amine or the derivative thereof added to the developer.

Yet a further object of the invention is to provide a process for accelerating the course of development and changing the tone of a transferred silver image.

A further object of the invention is to provide a developer relatively insensitive to variations in development temperature.

Still a further object of the invention is to provide a process for preparing a silver image having metallic gloss at the surface thereof.

Still yet a further object of the invention is to provide a process for preventing hardening of a negative emulsion layer of a multi-layer type diffusion transfer light-sensitive material by a quinone and to impart a good delaminating property between the negative emulsion layer and a positive image-receiving layer.

The above-described objects of the invention are attained by using a lithographic type diffusion transfer developing composition prepared by adding an amine compound to a conventionally known diffusion transfer developing composition, that is, the present invention relates to a photographic developing composition to be used in a process of diffusion transfer development using a silver halide light-sensitive material, wherein an amine or a derivative thereof is incorporated in the developing composition.

Figures 1, 2, 3, 4, 5, 6:
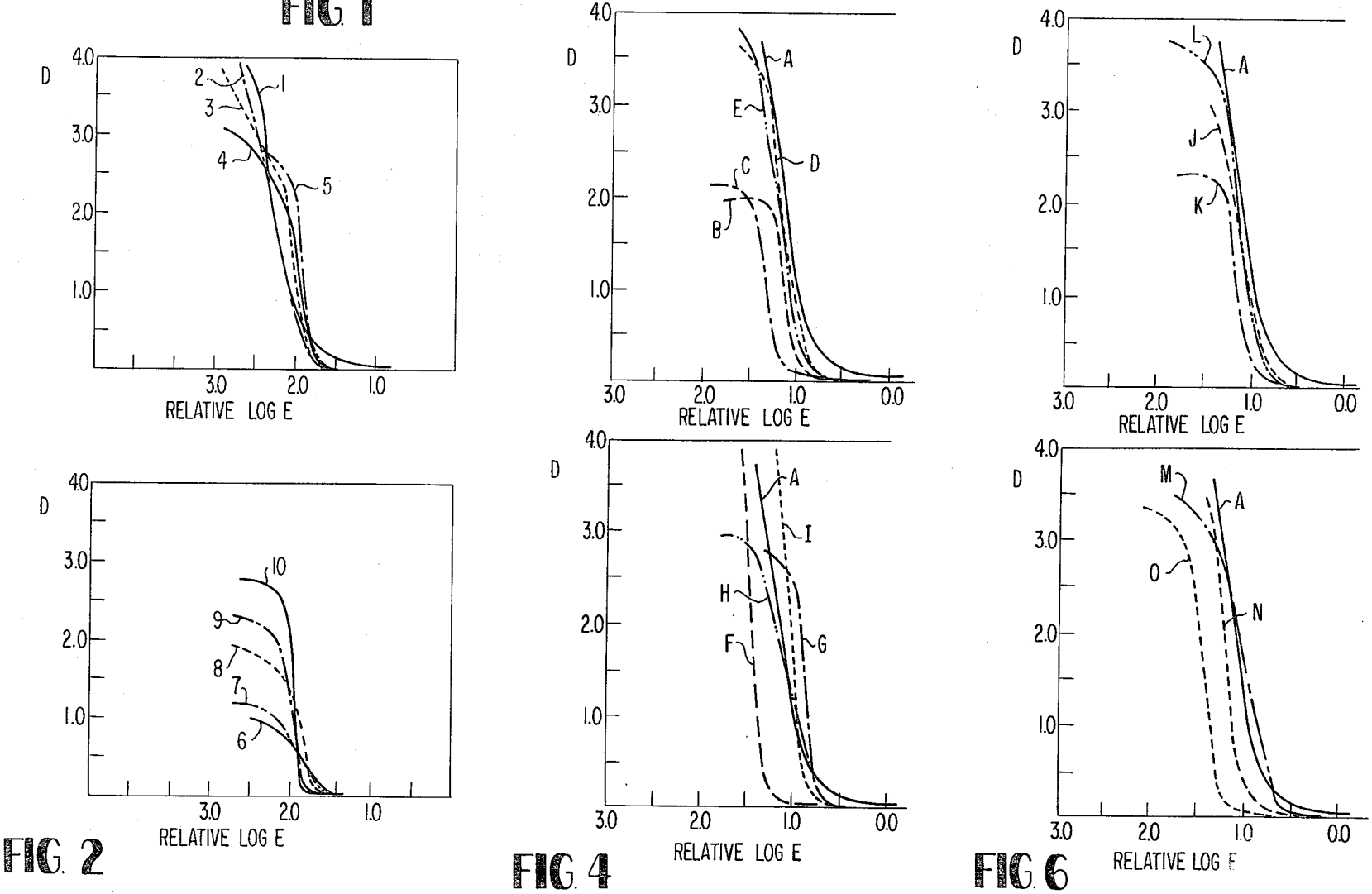
FIG. 1 shows the characteristic curve of the image obtained in Example 1.
FIG. 2 shows the characteristic curve of the image obtained in Example 2.
FIGS. 3–6 show characteristic curves of the images obtained in Example 7.

In each of FIGS. 1–6 the vertical axis is density and the horizontal axis is Log E (log exposure).

DETAILED DESCRIPTION OF THE INVENTION

In the conventional process of silver salt diffusion transfer development, a latent image is formed in a silver halide layer by imagewise exposure and the image then subjected to a chemical development to form a silver image. There is thus formed a negative image of the original. Non-exposed silver halide reacts with a silver salt-dissolving agent to form a soluble silver complex compound which diffuses into an image-receiving layer, comes into contact with a nuclear substance for physical development present in the image-receiving layer and is then reduced to metallic silver to form a positive silver image.

In such a process the contrast of the transferred silver image is usually much lower than that in a lithographic type development.

Accordingly, in the case of breaking up the original directly into half-tone dots by covering the original with a screen only a soft-dot silver image results when a diffusion transfer development is employed. As can be expected from the principles of photographing half-tone dots, this results from the fact that the light pattern of the meshes of a screen is of the hill and valley type, where the light is strongest in intensity at the central areas and weakest at outlying areas, the light intensity changing continuously therebetween. Further, since a photographic light-sensitive material has the property of expressing intermediate densities as well as the maximum density (fog) and minimum density necessary to form half-tone dots, a silver image is naturally formed in conformity with the light pattern.

From the above, it will be seen that the density of the half-tone dots becomes lower at areas remote from the center of the mesh pattern, and thus there is usually produced an area having a density gradient inconvenient for plate-making. It has thus been impossible to prepare a photographic half-tone dot original plate by diffusion transfer processing using a diffusion transfer light-sensitive material.

The present inventors have overcome the above-described difficulties on the basis of the discovery that when an amine- or amine derivative-containing diffusion transfer developing composition is used the photographic characteristic of expressing intermediate density regions described above largely disappears while there is caused a marked increase in contrast or a shortening of the exposure range of the toe part in the sensitivity curve (hereinafter referred to as "toe-gradation").

As a result, there can be provided a half-tone dot image having far greater density than that obtainable in accordance with the prior art which has extremely less fringe around the dot images and which is a hard-dot silver half-tone image as is obtained by lithographic development. Thus, a good half-tone dot photographic original plate can successfully be prepared by directly covering an original having a continuous gradation with a screen.

A further novel merit provided by the invention is that the maximum density of a positive silver image can be increased or decreased without a reduction in contrast or a deterioration in toe-gradation. That is, this object can be attained by varying the amount of amine compound added to the diffusion transfer developing composition.

In addition, the composition of the present invention is less dependent upon temperature, enables a negative emulsion layer to be delaminated with extreme ease in the case of a multi-layer light-sensitive material and markedly accelerates the course of development when used in combination with a sulfite ion-free diffusion transfer type developing composition.

Furthermore, in addition to the conventionally known effects of amines, e.g., improvement of preservability and changing of tone of a developer, the composition of the present invention has a sensitizing effect such that the position of the characteristic curve shifts in the direction of lowered exposure amounts. Thus, the effects of the composition of the invention are extremely diverse.

There have heretofore been known various effects of the addition of amines or the derivative thereof to a developer. For example, in a diffusion transfer development, a sulfohydroxylamine has been added as a developing agent particularly effective for a process of diffusion transfer development (U.S. Pat. No. 3,287,124), a hydroxylamine hydrochloride has been added to a processing solution to improve the storage property of both the processing solution and the positive image resulting from the use of the processing solution (British Pat. No. 1,178,713) and an aliphatic amine has been used as an alkali agent in a developer (U.S. Pat. No. 3,386,825). An amine or the derivative thereof has also been added to a general developer, for example, an alkali metal salt of triethanolamine has been used as an alkali agent (U.S. Pat. No. 2,017,167), a salt of a primary, secondary or tertiary aliphatic amine has been added together with a developing agent as a developer for forming a fine-grained image (U.S. Pat. No. 2,113,312), triethanolamine has been used to shorten the developing time and to improve the storage property of a developer (U.S. Pat. No. 2,657,138), hydrazine and triethanolamine have been added to shorten the developing time without changing the grain property of the developer and the contrast (U.S. Pat. No. 2,882,152), an ammonia derivative having a hydroxyalkyl group has been added to control alkalinity and to prepare a concentrated developer (British Pat. No. 430,916) and triethanolamine has been added to a solution for combined developing and fixing (British Pat. No. 571,389).

However, the present invention is absolutely different in its objects from the above-described prior art, and the point of the present invention lies in the discovery of novel effects different from the effects known with respect to amines or the derivatives thereof.

That is, as is previously stated, a conventional diffusion transfer developer provides such low contrast that there occurs an area of intermediate density, resulting in the formation of an area of intermediate density, called fringe, around the dots formed. Therefor, as a developer for preparing a half-tone dot photographic original plate for printing utilizing a lithographic type light-sensitive material or other high contrast light-sensitive material there has usually been employed a lithographic type infectious developer.

In addition, as examples of adding amines or amine derivative to a lithographic type developer, there is known a developer prepared by adding a condensation product between a bisulfite addition derivative of a carbonyl compound and an amine compound and a free amine in order to reduce the bromide streaks of a light-sensitive material for printing caused by processing with an automatic developing machine and to improve the stability of the solution (French Pat. No. 1,539,407). However, the formulation of this developer contains a hydroquinone derivative as a developing agent and the developer is used at the pH of less than about 10.5 using a reaction product between a bisulfite derivative of formaldehyde and an amine compound as the reaction product between bisulfite derivative of carbonyl compounds and amines, and a primary or secondary amine in combination. In particular, the presence of free sulfite ion is extremely important in this case.

On the other hand, the diffusion transfer developing composition in accordance with the present invention is characterized in that a developing agent of the pyrazone-hydroquinone system, metol-hydroquinone system or a like system is used, and the pH of the developer belongs to high pH systems, i.e., above 9.5 pH. Development with such a developing composition is completely different from any conventionally known lithographic development.

Another novel aspect of the present invention is that when a diffusion transfer developing composition containing an amine or a derivative thereof in accordance with the present invention is used acceleration of development due to an increase in the silver density of a positive image (see Example 2) and the sensitization of the total characteristic curve shifting in the direction of low exposure amounts (see Example 7, C, D, F and O) occurs, depending upon the composition of the developer. For example, the following compounds provide for such sensitization:

B. hexamethylenediamine

C. monoethanolamine

D. (trishydroxymethy)aminomethane

E. glycine
F. 2-amino-2-methyl-1,3-propanediol
K. N-methylbenzylamine
N. N-methylethanolamine
O. tert-butylhydroquinone, and the like.

Thus, both an acceleration of the development and a sensitization can be attained.

Further, in a multi-layer light-sensitive material a negative emulsion layer can be prevented from being hardened by any hydroquinone oxidation product, i.e., quinone, which serves to improve the delamination property between the negative emulsion layer and a positive image-receiving layer.

Furthermore, the maximum density can be varied without a reduction in contrast, and the photographic characteristics change extremely little over a wide range of developing temperatures.

These merits have not been known in the prior art, and constitute main aspects of the present invention.

Still further, the preservability and durability of the developer are improved and few bromide streaks due to processing by means of an automatic developing machine are encountered.

The diffusion transfer developing composition used in the invention is characterized in that at least one amine derivative is incorporated in a normally used diffusion transfer developer, e.g., prepared by using pyrazone 1-phenyl-3-pyrazolidone, or p-methylaminophenol, and hydroquinone as the major components and which contains a silver-complexing agent, a halide, and alkali. As the developing agent, the combined use of 1-phenyl-3-pyrazolidone (or p-methylaminophenol) and hydroquinone is particularly prefered. However, other developing agents may also be used.

Sodium sulfite, sodium bisulfite, sodium metabisulfite, potassium metabisulfite, etc., are usually used as preservatives; sodium thiosulfate, potassium thiosulfate or like alkali metal thiosulfates, alkali thiocyanates, etc., are used as silver-complexing agents; potassium bromide is usually used as the halide; and sodium hydroxide, potassium hydroxide, potassium carbonate, lithium hydroxide, sodium carbonate, sodium phosphate, sodium secondary phosphate, borax, etc., are used as alkali agents.

However, other equivalent substances may also be used.

In addition, if desired, there can be added to the system organic anti-fogging agents such as benzotriazole, 1-phenyl-5-mercaptotetrazole, or the like, surface active agents such as quaternary ammonium salts, cationic surfactants, or the like, water softeners such as sodium hexametaphosphate, E.D.T.A. (ethylenediaminetetraacetic acid) or the like, and other additives as are usually employed in this area of the art.

The amines or the derivative thereof to be used in the developer of the present invention are represented by the following general formulae (I), (II) or (III):

$$H_2N\text{-}C_nH_{2n}\text{-}X \qquad (I)$$

wherein X represents a hydrogen atom, a hydroxy group, a carboxy group or an amino group and n represents O or an integer of 1–12, provided that when n=0, X represents a hydroxy group;

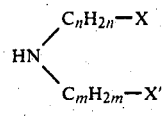

$$HN(C_nH_{2n}\text{—}X)(C_mH_{2m}\text{—}X') \qquad (II)$$

wherein X and X′ represent hydrogen atoms, hydroxy groups, carboxy groups or amino groups and n and m represent 0 or integers of 1–12, provided that X represents a hydroxy group when n=0, and X′ represents a hydroxy group when m=0;

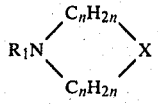

$$R_1N(C_nH_{2n})_2X \qquad (III)$$

wherein X represents an oxygen atom, $CH_2$, or $—NR_2$, $R_1$ and $R_2$ represent hydrogen atoms, alkyl groups having 1–12 carbon atoms, which term includes unsubstituted and substituted alkyl groups so long as 1–12 carbon atoms are present in the alkyl moiety, or acyl groups ($R_3CO$—) wherein $R_3$ represents a hydrogen atom, an alkenyl group having 1–12 carbon atoms such as a vinyl group or an alkyl group having 1–12 carbon atoms, which term includes unsubstituted and substituted alkyl groups so long as 1–12 carbon atoms are present in the alkyl moiety, and n represents an integer of 2 or 3.

Exemplary of substituted alkyl groups in the amines of general formula III are, for $R_1$ and $R_2$, hydroxyalkyls such as hydroxyethyl, 2-hydroxy-2-methylethyl, carboxyalkyls such as carboxyethyl, aminoalkyls such as aminoethyl, acylaminoalkyls such as acylaminoethyl, cyanoalkyls such as cyanoethyl, acylalkyls such as acylethyl etc., and for $R_3$, chloroalkyls such as 2-chloroethyl, 1-chloroethyl, alkoxyalkyls such as methoxymethyl, aryloxyalkyls such as phenoxymethyl, phenoxypropyl, carboxyalkyls such as carboxyethyl, hydroxyalkyls such as hydroxyethyl and the like.

The primary criterion which must be met is that the alkyl group have 1–12 carbon atoms. So long as this criterion is met the exact substituent present is not overly critical so long as the substituent does not exert a harmful effect in the system. It is to be understood that the present invention is not predicated upon the discovery of novel substituted forms of the amines of general formula (III), rather, this discussion is to make it clear the use of a substituted alkyl group in the $R_1$, $R_2$ or $R_3$ position does not fall outside the essential teaching of this invention.

Specific examples of the compounds represented by the above-described general formulae (I), (II) and (III) used in the invention are, for example, hexamethylenediamine, cyclohexylamine, glycine, hydroxylamine, ethanolamine, di-isopropanolamine, N-methylethanolamine, 2-amino-2-methyl-1,3-propanediol, dimethylamine, diethylamine, diisobutylamine, N-methylbenzylamine, piperazine, aminoethylpiperazine, morpholine, methylpiperazine, hydroxyethylmorpholine, dimethylpiperazine and the like.

Amines or the derivative thereof used in the diffusion transfer developing composition of the invention can be added in an amount ranging from about 0.1 to about 250 g, most preferably 10–120 g, per 1 liter of the developing composition. Mixtures of amines, derivatives or amines and derivatives may also be used.

The preferred developing compositions of the present invention thus comprise a principal developing agent, an alkali, a silver halide dissolving agent and one or more amines of general formulae (I) to (III).

The preferred developing agents comprise a 3-pyrazolidone and/or an aminophenol with a polyhydroxybenzene. The 3-pyrazolidone and/or aminophenol are generally present in an amount of from about 0.01 to about 20 g/l, preferably 0.5–5 g/l, of developer in combination with the polyhydroxybenzene which is present in an amount of from about 1 to about 50 g/l, preferably 3 to 20 g/l, of developer.

Specific examples of 3-pyrazolidone compounds are 1-phenyl-3-pyrazolidone, 1-p-tolyl-3-pyrazolidone, 1-phenyl-4-methyl-3-pyrazolidone, 1-phenyl-4,4-dimethyl-3-pyrazolidone and 1-p-chlorophenyl-3-pyrazolidone.

Specific examples of aminophenol compounds are N-methyl-p-aminophenol, p-aminophenol, 2,4-diaminophenol, p-benzylaminophenol, 2-methyl-p-aminophenol and 2-hydroxymethyl-p-aminophenol.

Specific examples of polyhydroxybenzene compounds are hydroquinone, catechol, chlorohydroquinone, pyrogallol, bromohydroquinone, isopropylhydroquinone, toluhydroquinone, methylhydroquinone, 2,3-dichlorohydroquinone, 2,5-dimethylhydroquinone and 2,3-dibromohydroquinone.

The present invention is not, of course, limited to such species, and equivalent pyrazolidones, aminophenols and polyhydroxybenzenes can be used.

The alkali is generally present in an amount of from about 1 to about 200 g/l, preferably 5 to 100 g/l, of developer.

Preferred alkali materials are inorganic alkali agents such as metaborates, sodium hydroxide, potassium hydroxide, sodium carbonate, lithium hydroxide, sodium phosphate, ammonia etc. Other equivalent alkali agents, including organic alkali materials can also be used, though the recited materials function very well and are low in cost, and for this reason are preferred.

When the amine of general formulae (I)–(III) is strongly alkaline, e.g., when the developing solution is pH 10.5–13, the alkalies need not be added in the developing solutions since the amines per se provide sufficient alkalinity.

The silver halide dissolving agent is generally used in an amount of from about 1 to about 200 g/l, preferably 5 to 30 g/l, of developer. Preferred materials for this purpose include alkali metal thiosulfates such as sodium thiosulfate, potassium thiosulfate, etc., alkali thiocyanates, alkali selenocyanates, thioglycerol, an aminoalkanethiol, e.g., aminoethanethiols, etc. Equivalent materials known to the art can, of course, be used.

If desired, mixtures of various specific compounds can be used, rather than any one specific compound.

A preferred optional compound is a preservative which is generally used in an amount of from 0 to about 200 g/l, preferably 0 to 100 g/l, of developer component.

Preservatives known in the art can be used with success, e.g., sulfites such as sodium sulfite, acid sodium sulfite, etc.

Optional components often used are inhibitors, generally in an amount of from 0 to about 50 g/l, preferably less than 20 g/l of developer, and anti-fogging agents, generally in an amount of from 0 to about 10 g/l, preferably less than 3 g/l, of developer. Preferred inhibitors include potassium bromide, sodium bromide, etc., and preferred anti-fogging agents include heterocyclic compounds such as benzotriazole, benzothiazole, 1-phenyl-5-mercaptotetrazole, 2-mercaptobenzothiazole, etc.

The developing composition of the invention may also be used in the form of a concentrated liquid developer containing a liquid developing agent, an organic solvent, etc., a viscous developer containing a hydrophilic resin or as a powdery developer.

Effective hydrophilic solvents as can be used to form concentrated developers include solvents which mix with water, for instance, glycols such as ethylene glycol, diethylene glycol, Cellosolve such as methyl Cellosolve, ethyl Cellosolve etc., alcohols such as ethyl alcohol, methyl alcohol, propyl alcohol, etc., ketones such as acetone, methyl ethyl ketone, etc.

As effective hydrophilic resins, there are the hydrophilic resins which dissolve in water, for instance, methyl cellulose, carboxymethylcellulose, hydroxyethylcellulose, ethylcellulose, alginates, polyvinyl alcohol, polyvinyl pyrrolidone, and the like.

The amine can also be contained in a powdery developer, and the powdery developer can be used by adding a known powdery diffusion transfer developing agent to a liquid which dissolves the same.

The temperature of development will generally be from about 5 to about 40° C., more preferably 1 to 35° C. While development can be accomplished in as little as about 5 seconds or as long as about 5 minutes, more generally 15 to 20 seconds is sufficient. Nitrogen gas can be bubbled into the developer to prevent the oxidation of the developer and to agitate the developer. Either settled developing or rocking developing may be used.

The above factors can be balanced by one skilled in the art using known techniques to operate outside the above ranges, though, practically speaking, little need exists to go to such trouble.

As the light-sensitive material used in this invention, there may be used separate type light-sensitive materials where an image-receiving material containing silver diffusion transfer nuclei and a silver halide light-sensitive material are separate from each other and multilayer light-sensitive materials where a light-sensitive silver halide emulsion is directly coated on an image-receiving material.

Those light-sensitive materials as are known in the art may be processed with success. While the exact character of such elements can vary greatly, usually the receiving layer is about 0.1 to about 3μ thick, more typically 0.5 to 2μ thick. It is preferred to use receiving layers of low hardness. The weight ratio of nuclei : binder in such materials is generally about $1\times10^{-1}$ to 1 to about $1\times10^{-6}$ to 1, more typically $1\times10^{-5}$ to $1\times10^{-4}$ to 1, with a general order of use for commercial elements being 0.001 mg/l.

As the light-sensitive silver halide emulsion layer, any of those known in the art may be used, but preferred are the emulsion layers where the exposed silver salt can be rapidly developed in the step of diffusion transfer development while the non-exposed silver salt can rapidly form a complex compound and can be rapidly reduced in an image-receiving layer.

The silver halide can be selected from among those generally used, e.g., silver chloride, silver bromide, silver iodide, silver chlorobromide, silver chloroiodide, silver bromoiodide, silver chlorobromoiodide, etc.

The preferred silver halides include silver chloride and silver chlorobromide emulsions containing 10–30 mole % of silver bromide.

As the binder, gelatin is usually used, but other hydrophilic colloids can also be used, e.g., phthalated gelatin, vinyl-derivatives such as polyvinylpyrrolidone, polyvinyl alcohol, etc. The binder is selected from those generally used in the art. The proportion of silver halide to binder agent is preferably large, in particular, a proportion of binder to silver halide of about 0.4–0.6 is advantageous for obtaining half-tone hard dot images.

In most commercially used elements the thickness of the emulsion layer is usually 1–15μ, more typically 3–8μ, the weight ratio of AgX/binder is usually ¼–6/1, more typically 1/1–4/1 and the amount of silver is usually 5–60 mg/dm², more typically 10–30 mg/dm². These values are only included as illustrative, of course.

To the silver halide emulsion there may be added, if desired, the usually employed additives in this art such as sensitizing agents, sensitizing dyes, anti-fogging agents, hardeners, surfactants, and the like. An emulsion having contrasty photographic characteristics is particularly preferable.

In addition, as the medium for the image-receiving layer wherein a nuclear substance for physical development is dispersed, any of those conventionally used in the field may be used.

As the nuclear substances which can be employed there are colloidal silver, silver sulfide, nickel sulfide, zinc sulfide, sodium sulfide, colloidal sulfur, thiosinamine, stannous chloride, chloroauric acid, etc., all of which are commonly used and well known in this art.

The present invention is based in the features described above, and the developer in accordance with the invention provides a silver image having an extremely small intermediate density between dots and excellent half-tone dot characteristics. A half-tone dot positive silver image thus prepared can be used as a half-tone photographic original plate capable of being directly printed on an offset printing plate or, after fat-sensitization processing, capable of being printed on a printing plate or a PS plate (presensitized plate). In addition, the developer of the invention can be applied to any photographic excess which requires high contrast. In a typical fat-sensitization the silver image is immersed in the following treating solution at 20° C. for 30 seconds:

| | | |
|---|---|---|
| Water | 500 cc | |
| Benzotriazole | 1 g | |
| Potassium citrate | 1 g | (dissolved at 20° C. in ethyl alcohol) |
| Cupric chloride | 10 g | |
| Potassium bromide | 20 g | |

The present invention will now be illustrated in greater detail by several non-limiting examples of preferred embodiments.

The basis for all percentages in the examples is weight percent. And, all thickness are dry thickness, unless otherwise indicated.

EXAMPLE 1

A polyethylene terephthalate film 0.18 mm thick was surface-treated with a solution containing sulfuric acid, phosphoric acid and potassium dichromate ($H_2SO_4$400 cc, $H_3PO_4$200 cc, $K_2Cr_2O_7$ 70 g, water to make 3 l immersed at 50° C., for 3 minutes). Thereafter, an anti-halation layer was applied to one side thereof. A gelatin dispersion in an organic solvent having the following composition was then applied to the opposite side and dried at 120° C. for 2 minutes to form an intermediate layer 0.2 microns thick.

| | |
|---|---|
| Gelatin | 1 g |
| Water | 1 g |
| Acetic acid | 1 g |
| Methanol | 20 g |
| Acetone | 60 g |
| Methylene chloride | 10 g |
| Tetrachloroethane | 5 g |
| Phenol | 5 g |

To the resulting intermediate layer there was applied an aqueous solution of gelatin of the following composition containing a nuclear substance for physical development, and the aqueous solution was dried at 60° C. for 60 minutes to form a hydrophilic diffusion transfer image-receiving layer 0.5 microns thick.

| | |
|---|---|
| Nickel sulfide gelatin dispersion<br>Nickel sulfide $5 \times 10^{-4}$%<br>Gelatin 0.5% | 0.4 g |
| Gelatin | 0.4 g |
| Water | 100 g |
| 1% Aqueous solution of sodium dodecylbenzenesulfonate | 0.4 g |
| 1% Aqueous solution of chromium acetate | 5 g |

To the resulting image-receiving layer was applied a lithographic, non-hardened gelatino-silver chlorobromide emulsion (containing 70% silver chloride and 1 mol of silver per 1 Kg of emulsion) which provides high contrast at a thickness of 5 microns, and dried. Furthermore, as a protective layer, a 1% gelatin aqueous solution was applied thereto at a thickness of 1 micron.

A step wedge for sensitometry was photographed using the resulting light-sensitive materials. Thereafter, the light-sensitive materials were development-processed at 20° C. for 1 minute using 5 diffusion transfer developers having the following composition and washed with 30° C. The emulsion layers were then removed to yield positive images comprising a silver image. The properties of the thus obtained samples were compared. The results obtained are graphically presented in FIG. 1.

| Developer | 1 | 2 | 3 | 4 | 5 |
|---|---|---|---|---|---|
| Pyrazone | 2.0 g | 2.0 g | 2.0 g | 2.0 g | 2.0 g |
| Hydroquinone | 20 g | 20 g | 20 g | 20 g | 20 g |
| Anhydrous sodium sulfite | 60 g | 60 g | 60 g | 60 g | 60 g |
| Anhydrous sodium thiosulfate | 15 g | 15 g | 15 g | 15 g | 15 g |
| Sodium hydroxide | 20 g | 20 g | 20 g | 20 g | 20 g |
| Potassium bromide | 1 g | 1 g | 1 g | 1 g | 1 g |
| Diethanolamine | — | 15 g | 30 g | 60 g | 120 g |
| Water to make | 1 l | 1 l | 1 l | 1 l | 1 l |

From FIG. 1, it can be seen that as the amount of diethanolamine added increased the contrast became high and the toe-gradation became sharper. Thus, the developer containing diethanolamine in greater amounts showed lithographic characteristics. The toe-gradation was correlated with the width of the fringe of the silver half-tone dot image obtained by covering a light-sensitive material with a screen and directly photographing the original through the screen, i.e., a developer providing sharper toe-gradation more greatly reduced the width of the fringe of a silver half-tone dot image and provided a hard dot silver half-tone image. In addition, the maximum density decreased depending upon the amount of diethanolamine added.

EXAMPLE 2

The procedures described in Example 1 were repeated except that the development was conducted at 20° C. for 30 seconds using sulfite-free, ascorbic acid-containing developers of the following compositions and changing the amount of diethanolamine.

| Developer | 6 | 7 | 8 | 9 | 10 |
|---|---|---|---|---|---|
| Pyrazone | 2 g | 2 g | 2 g | 2 g | 2 g |
| Hydroquinone | 20 g | 20 g | 20 g | 20 g | 20 g |
| Anhydrous sodium thiosulfate | 15 g | 15 g | 15 g | 15 g | 15 g |
| Sodium hydroxide | 20 g | 20 g | 20 g | 20 g | 20 g |
| Potassium bromide | 1 g | 1 g | 1 g | 1 g | 1 g |
| Ascorbic acid | 20 g | 20 g | 20 g | 20 g | 20 g |
| Diethanolamine | — | 10 g | 20 g | 40 g | 80 g |
| Water to make | 1 l | 1 l | 1 l | 1 l | 1 l |

The results obtained are graphically presented in FIG. 2.

From the results given in FIG. 2, it can be seen that the lithographic type, sodium sulfite-free diffusion transfer developer of the present invention containing diethanolamine provided extremely high contrast and, with increased amounts of diethanolamine, the toe-gradation became sharper, the contrast became higher and the maximum density was increased. In addition, with increased amounts of diethanolamine the preservability of the developer was improved.

EXAMPLE 3

The procedures described in Example 1 were repeated using developers No. 1 and No. 5 of Example 1 except the development was conducted for 30 seconds at various temperatures.

| | Prescription | Temp. 5° C. | 10° C. | 15° C. | 20° C. | 25° C. | 30° C. | 35° C. | 40° C. |
|---|---|---|---|---|---|---|---|---|---|
| Gamma | 1 | 0.8 | 3.7 | 6.3 | 6.0 | 5.8 | 5.9 | 6.2 | — |
| Gamma | 5 | 2.1 | 2.9 | 8.3 | 8.5 | 8.5 | 8.6 | 8.4 | 8.4 |
| Toe-gradation* | 1 | 0.25 | 0.21 | 0.44 | 0.30 | 0.35 | 0.51 | 0.45 | — |
| | 5 | 0.40 | 0.45 | 0.14 | 0.15 | 0.16 | 0.16 | 0.14 | 0.13 |

*Expressed in terms of the logarithmic values of exposure amount required for 0.1-0.5 in D value.

It is seen that diethanolamine-containing Developer No. 5 underwent less change in photographic characteristics than diethanolamine-free Developer 1 over a wide range of developing temperatures of from 15° C. to 40° C., i.e., the diethanolamine-containing developer is little dependent upon developing temperature.

EXAMPLE 4

The procedures described in Example 1 were repeated except that a solution having the following composition was used as the developer.

| | |
|---|---|
| Ascorbic acid | 10 g |
| Hydroquinone | 15 g |
| Pyrazone | 2 g |
| Anhydrous sodium thiosulfate | 15 g |

-continued

| | |
|---|---|
| Potassium bromide | 1 g |
| Sodium hydroxide | 20 g |
| Hydroxylamine sulfate | 20 g |
| Water to make | 1 liter. |

The developed element showed the following photographic properties comparable to those obtained with a lithographic development.

| | |
|---|---|
| Gamma | 12 |
| Maximum density | 3.8 |
| Toe-gradation | 0.03 |

The addition of hydroxylamine sulfate also improved the preservability of the developer.

Similar results were obtained with the other compounds represented by the foregoing general formulae.

EXAMPLE 5

0.01 Gram of 1-phenyl-5-mercaptotetrazole was added to 1 Kg of a silver chlorobromide emulsion and the emulsion coated to a thickness of 4 microns on a support and then dried to prepare a light-sensitive material. After exposure, the resulting material was subjected to development for 30 seconds at 20° C. in the following developer.

| | |
|---|---|
| Pyrazone | 2 g |
| Anhydrous sodium sulfite | 80 g |
| Hydroquinone | 10 g |
| Anhydrous sodium thiosulfate | 10 g |
| Sodium hydroxide | 15 g |
| Potassium bromide | 1 g |
| Diethanolamine | 30 g |
| Water to make | 1 liter. |

After development, the emulsion layer was removed with warm water to obtain a positive silver image having a middle-gray tone.

The addition of 1-phenyl-5-mercaptotetrazole and diethanolamine to the emulsion and the developer, respectively, served to provide an image having more middle-gray tones. As to the other photographic properties, the same results as in Example 1 were obtained.

EXAMPLE 6

A cellulose triacetate film 150 microns thick was immersed at 30° C. for 60 seconds in the following sodium hydroxide solution containing nickel sulfide as the nuclei for physical development, lightly washed and then dried. There was thus obtained a sheet of material containing as the nuclear substance for a diffusion transfer process nickel sulfide at the hydrophilic surface portion thereof. To the resulting sheet material there was applied a silver chloride emulsion (containing 70% silver chloride) containing 1 mol of silver per Kg at a thickness of 4 microns to prepare a light-sensitive material.

| | |
|---|---|
| Sodium hydroxide | 2.5 Kg |
| Methyl alcohol | 8 Kg |
| Nickel sulfide dispersion (0.1%) | 1 Kg |
| Water to make | 15 Kg |

After exposing the resulting light-sensitive material, development was conducted using the developers described in Examples 1–5 to obtain the same results as in Examples 1–5.

EXAMPLE 7

A step wedge for sensitometry was photographed using the light-sensitive materials prepared in Example 1. Thereafter, the light-sensitive materials were developed at 25° C. for 1 minute using each of the following 15 diffusion transfer developers and washed with warm water at 30° C. to remove the emulsion layer and to thereby yield positive images comprising silver images. Comparison samples were thus obtained.

Basic compositions of developers:

| | |
|---|---|
| Pyrazone | 1.5 g |
| Hydroquinone | 10 g |
| Anhydrous sodium sulfite | 80 g |
| Sodium hydroxide | 14 g |
| Potassium bromide | 0.9 g |
| 1-Phenyl-5-mercaptotetrazole (0.5% methanol solution) | 2 cc |
| Water to make | 1 liter. |

Each of the following amine derivatives was added to the basic composition thereto in the amount given below. The results obtained as to the photographic properties are shown in FIG. 3.

| | |
|---|---|
| A no additive | 0 g |
| B hexamethylenediamine | 10 g |
| C monoethanolamine | 10 g |
| D (trishydroxymethyl) | 10 g |
| E glycine | 10 g |
| F 2-amino-2-methyl-1,3-propanediol | 50 g |
| G diethanolamine | 120 g |
| H dimethylamine | 10 g |
| I hydroxylamine sulfate | 20 g |
| J diisobutylamine | 50 g |
| K N-methylbenzylamine | 50 g |
| L piperazine | 10 g |
| M di-isopropanolamine | 50 g |
| N N-methylethanolamine | 50 g |
| O tert-butylamine | 10 g |

From the results shown in FIG. 3, it can be seen that all of the amine compound-containing developers were effective for providing a sharp toe-gradation.

While the invention has been described in detail and with reference to specific embodiments thereof, it will be apparent to one skilled in the art that various changes and modifications can be made therein without departing from the spirit and scope thereof.

What is claimed is:

1. A process for producing a high contrast image having a sharp toe-gradation which comprises exposing a silver halide light-sensitive material and developing using a diffusion transfer development process for developing the silver halide light-sensitive material and producing an image in an image receiving layer containing diffusion transfer nuclei, the improvement comprising using, as a lithographic type diffusion transfer developer, a developer prepared from a developer composition containing (1) a developing agent comprising:
  (A) one or more 3-pyrazolidones and/or one or more aminophenols and
  (B) one or more polyhydroxybenzenes;
(2) an alkali;
(3) a silver halide dissolving agent; and
(4) at least one of the amines represented by the following general formulae (I), (II) and (III):

$$H_2N\text{-}C_nH_{2n}\text{-}X \quad \text{(I)}$$

wherein X represents a hydrogen atom, a hydroxy group, a carboxy group or an amino group, n represents an integer of 1–12,

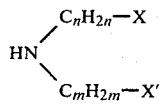

(II)

wherein X and X' represent hydrogen atoms, hydroxy groups, carboxy groups or amino groups, n and m represent integers of 1–12,

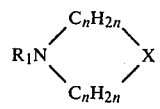

(III)

wherein X represents an oxygen atom, —$CH_2$— or —$NR_2$—, $R_1$ and $R_2$ each represents a hydrogen atom, an alkyl group or substituted alkyl group each having 1–12 carbon atoms or an acyl group of the formula $R_3CO$- wherein $R_3$ represents a hydrogen atom or an alkyl group, a substituted alkyl group or an alkenyl group each having 1–12 carbon atoms, and n represents an integer of 2 or 3, and where the recited components of the developer composition are present in the developer composition in proportions such that, in 1 liter of developer prepared from said developer composition, the recited components are present in the following amounts:

(1) developing agent comprising components (A) and (B): about 1.01 g to about 70 g;
(2) alkali: about 1 g to about 200 g;
(3) silver halide dissolving agent: about 1 g to about 100 g; and
(4) amine: 0.5 to 250 g.

2. The process of claim 1, where the components (A) and (B) of the developing agent (1) are present in the developer composition in proporations such that, in 1 liter of developer prepared from said developer composition, the components (A) and (B) are present in amounts of:

(A) about 0.01 g to about 20 g; and
(B) about 1 g to about 50 g.

3. The process of claim 1, where development is for about 5 seconds to about 5 minutes at about 5° C. to about 40° C.

4. The process of claim 1, where the developer composition has a pH above 9.5.

5. The process of claim 1, wherein $R_1$, $R_2$ and $R_3$ in general formula (III), if alkyl groups, are unsubstituted alkyl groups.

6. The process of claim 1, where $R_1$, $R_2$ and $R_3$, if alkyl groups of 1–12 carbon atoms, are selected from the group consisting of, for $R_1$ and $R_2$: hydroxyalkyl, carboxyalkyl, aminoalkyl, acylaminoalkyl, cyanoalkyl and acylalkyl; and for $R_3$: chloroalkyl, alkoxyalkyl, aryloxyalkyl, carboxyalkyl and hydroxyalkyl.

7. The process of claim 1, wherein said composition consists essentially of said components (1)–(4) and said developing agent (1) consists essentially of said component (A) and said component (B).

8. The process of claim 1, wherein prior to development, said process includes exposing said silver halide light-sensitive material through a screen.

9. The process of claim 1, wherein in formula (I), X represents a hydrogen atom, a hydroxy group or a carboxy group, n represents an integer of 1–12; in formula (II), X and X′ represent hydrogen atoms, hydroxy groups or carboxy groups; and in formula (III), X represents $—CH_2—$ or $—NR_2—$, wherein $R_2$ is as defined in claim 1.

10. The process of claim 1, where the amine is dimethylamine, diisobutylamine, N-methylbenzylamine, tertbutylamine, monoethanolamine, diethanolamine, diisopropanolamine, N-methylethanoamine, glycine, (trishydroxymethyl)aminomethane, 2-amino-2-methyl-1,3-propanediol, hexamethylenediamine or piperazine.

11. The process of claim 1, wherein said component (A) of said developing agent (1) is 1-phenyl-3-pyrazolidone.

12. The process of claim 1, wherein said aminophenol is N-methyl-p-aminophenol, p-aminophenol, 2,4-diaminophenol, p-benzylaminophenol, 2-methyl-p-aminophenol and 2-hydroxymethyl-p-aminophenol.

13. The process of claim 1, wherein said polyhydroxybenzene of said component (B) of said developing agent is hydroquinone.

* * * * *